US008485372B2

(12) United States Patent
Ho

(10) Patent No.: US 8,485,372 B2
(45) Date of Patent: Jul. 16, 2013

(54) LOTION BOTTLE

(76) Inventor: Jui-Sheng Ho, Dali (TW)

( * ) Notice: Subject to any disclaimer, the term of this patent is extended or adjusted under 35 U.S.C. 154(b) by 287 days.

(21) Appl. No.: 12/896,838

(22) Filed: Oct. 1, 2010

(65) Prior Publication Data

US 2012/0080398 A1 Apr. 5, 2012

(51) Int. Cl.
*B65D 21/02* (2006.01)

(52) U.S. Cl.
USPC ..... 215/6; 215/247; 215/DIG. 3; 215/213; 215/227

(58) Field of Classification Search
USPC ..... 215/6, 11.1, 11.6, 227, 228, 376, 215/11.3; 206/219, 220, 221, 222, 232, 5.1
See application file for complete search history.

(56) References Cited

U.S. PATENT DOCUMENTS

| | | | | |
|---|---|---|---|---|
| 5,507,401 | A * | 4/1996 | Huang | 215/12.1 |
| 5,590,780 | A * | 1/1997 | O'Meara | 206/520 |
| 5,647,481 | A * | 7/1997 | Hundertmark et al. | 206/219 |
| 5,779,071 | A * | 7/1998 | Brown et al. | 215/11.5 |
| 6,276,853 | B1 * | 8/2001 | Breidenbach et al. | 401/34 |
| 6,450,179 | B2 * | 9/2002 | Bengis | 132/297 |
| 2002/0040720 | A1 * | 4/2002 | Byun | 132/112 |

* cited by examiner

*Primary Examiner* — Anthony Stashick
*Assistant Examiner* — Cynthia Collado

(57) ABSTRACT

A lotion bottle in which different lotions are received for separate use or mixed use is provided. The lotion bottle includes an outer bottle and an inner bottle. Different lotions are received in the outer bottle and the inner bottle respectively. By pushing out a rotating assembly, a lotion received in the inner bottle moves towards a feeding head so as to be mixed with the other lotion received in the outer bottle.

5 Claims, 4 Drawing Sheets

LOTION BOTTLE

BACKGROUND OF THE INVENTION

1. Field of the Invention

The present invention relates to a lotion bottle, and in particular to a lotion bottle in which different lotions are received for separate use or mixed use.

2. Description of the Prior Art

People today increasingly enjoy using lip gloss or eye shadow. Currently, the lip gloss or eye shadow is received in variously shaped containers such as a palette-like, a stick-like, a jar-like or a pen-like container, so that a user can carry the container around anywhere for ease of use. However, only one color of lip gloss or eye shadow can be received in the above-mentioned container, regardless of its shape. Thus, the user has to carry about a plurality of containers in which different colors or different color shades of lip gloss or eye shadow are received, which may be inconvenient for the user. On the other hand, with regards to a common skin care essence, it is usually constituted of a skin-care lotion having a skin-renewing effect and an auxiliary lotion without skin-renewing effects (such as a hydrating lotion or a moisturizer). The manufacturer usually mixes the skin-care lotion with the auxiliary lotion in a predetermined ratio, so that the user can use this mixed skin-care essence conveniently. However, if two different chemical lotions are mixed with each other for long periods of time, their chemical properties may change and even deteriorate. Further, when in use, the skin-care essence is inevitably brought into contact with external air, which may change the chemical properties of the skin-care essence and shorten its lifetime.

SUMMARY OF THE INVENTION

In view of the above problems, the present Inventor proposes a novel lotion bottle based on his expert knowledge relating to the design and manufacture of lotion bottles, whereby different kinds of lotions can be received therein for separate use or mixed use.

An object of the present invention is to provide a lotion bottle including an inner bottle and an outer bottle, so that different kinds of lotions are received in the inner bottle and the outer bottle respectively. By this structure, the user can separately use the lotions received in the inner bottle and the outer bottle, or use a mixture of the lotions received in the inner bottle and the outer bottle. In this way, the user can change the lotions received in the inner bottle and the outer bottle on demand, or mix the lotions received in the inner bottle and the outer bottle to thereby generate different color shades of lotions. On the other hand, since different lotions are received in the inner bottle and the outer bottle respectively, and mixed together when in use, the lifetime of the lotions is extended.

DETAILED DESCRIPTION OF THE INVENTION

The structural features and characteristics of embodiments of the present invention will be described in more detail with reference to a preferred embodiment thereof shown in the accompanying drawings.

Figure 1:
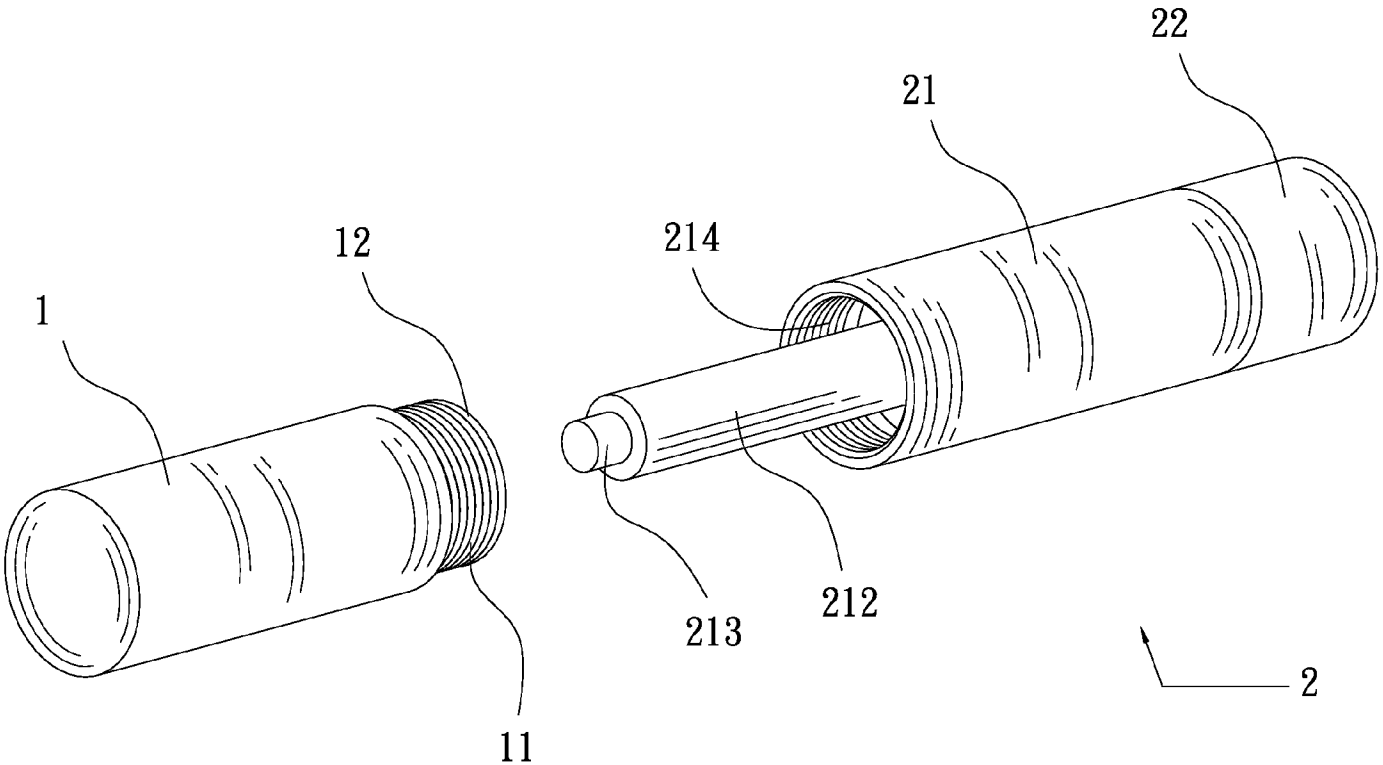
FIG. 1 is a partial exploded perspective view of an embodiment of the present invention.
Figure 2:
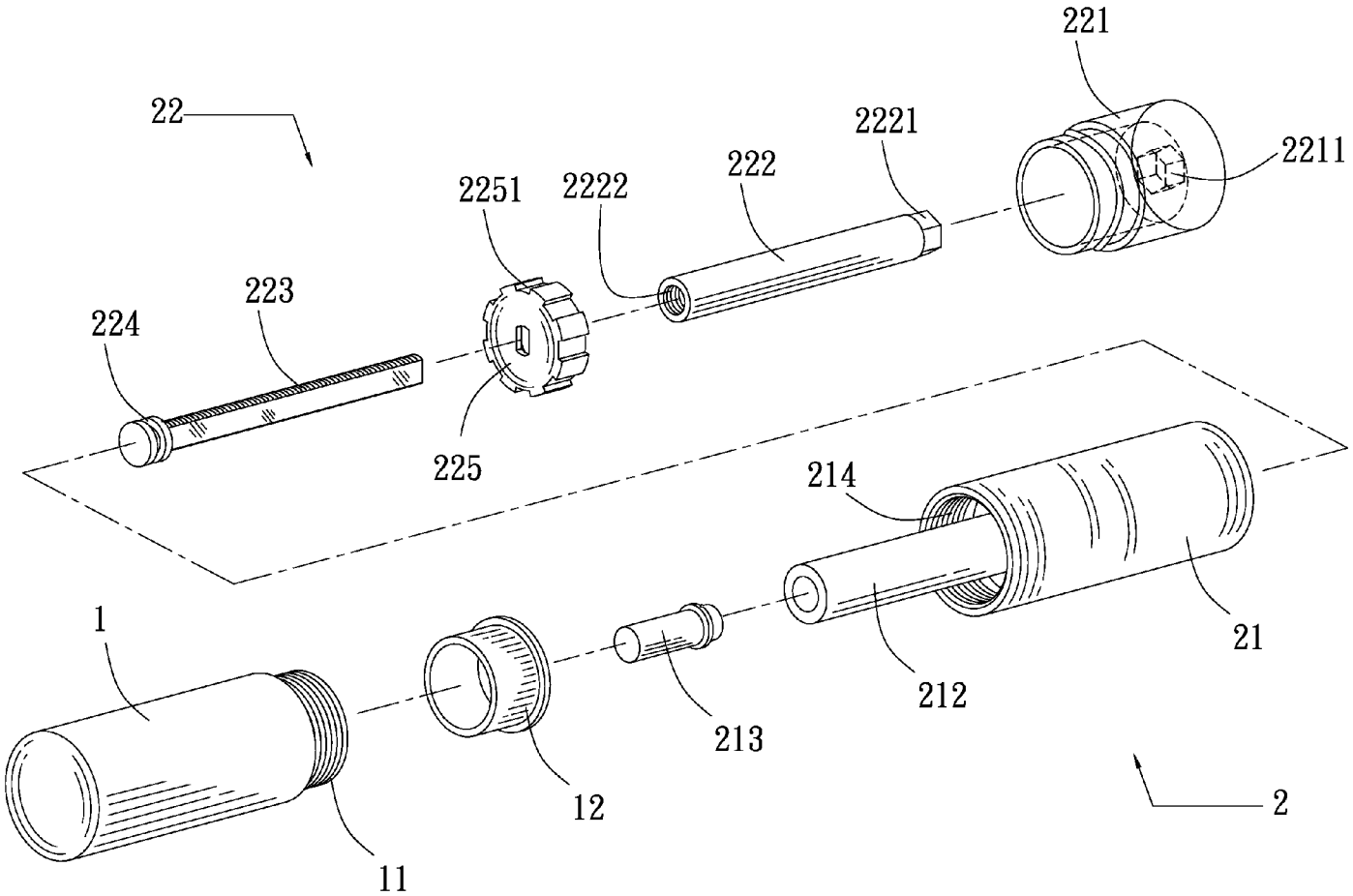
FIG. 2 is an exploded perspective view of an embodiment of the present invention.
Figure 3:
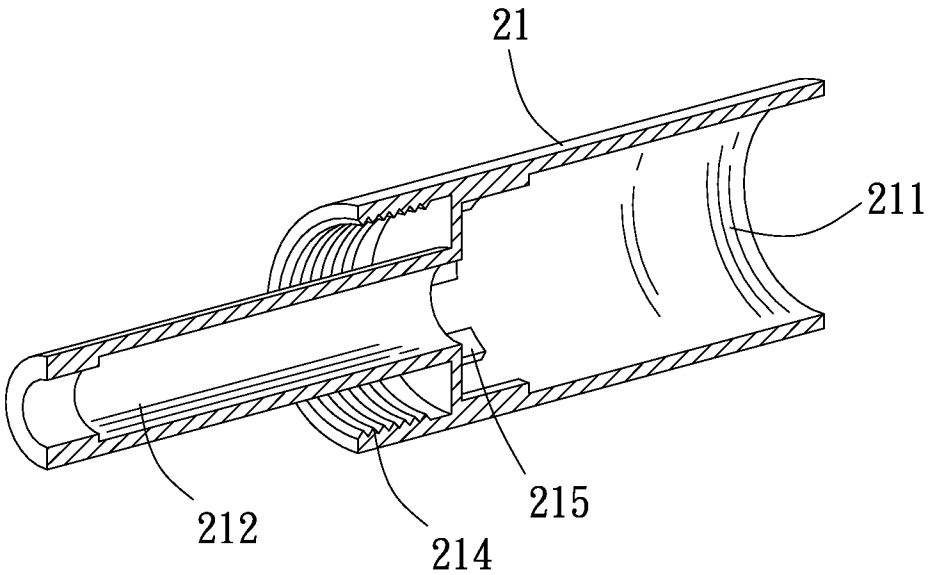
FIG. 3 is a cross-sectional perspective view showing an embodiment bottle body of the present invention.
Figure 4:
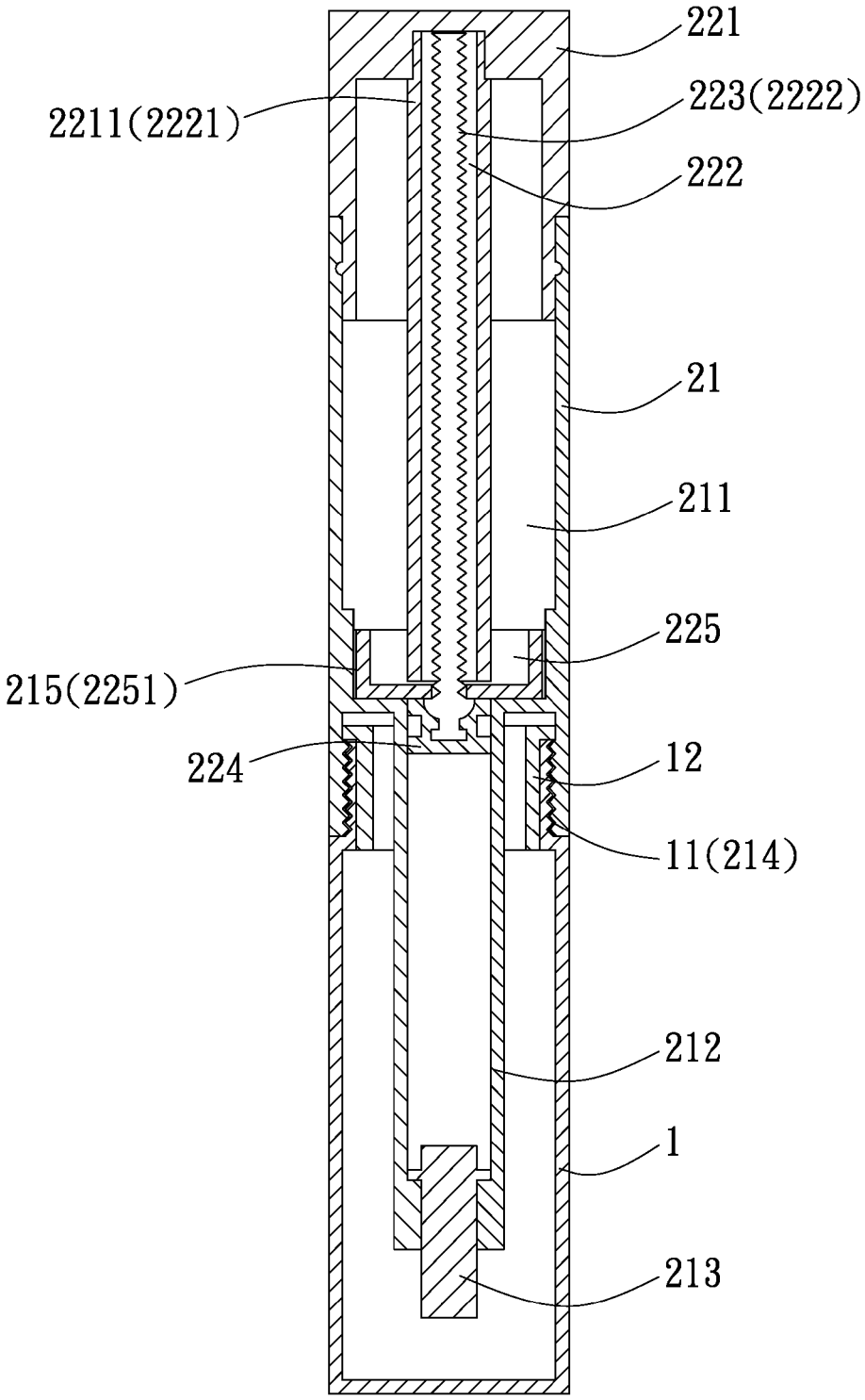
FIG. 4 is a cross-sectional view of an embodiment of the present invention.

Please refer to FIGS. 1 to 4. Embodiments of the present invention provide a lotion bottle, which includes an outer bottle 1 and an inner bottle 2.

The outer bottle 1 is a hollow bottle. The outer edge of the mouth of the outer bottle 1 is provided with a threaded section 11. An inner plug 12 is disposed in the mouth of the outer bottle 1.

The inner bottle 2 comprises a bottle body 21 and a rotating assembly 22. The mouth 211 of the body 21 allows a lotion to be received therein. A feeding pipe 212 integrally extends from the mouth 211 toward the interior of the bottle body 21. A feeding head 213 is disposed in the front end of the feeding pipe 212. One end of the bottle body 21 opposite the mouth 211 is formed with an inner threaded section 214. The interior of the mouth 211 is provided with a restricting recess 215. The rotating assembly 22 is disposed through the mouth 211 and connected thereto. The rotating assembly 22 has a rotating seat 221 in which a polygonal hole 2211 is provided. The rotating assembly 22 further has a pushing sleeve 222 having a polygonal seat 2221. The polygonal seat 2221 is disposed in the polygonal hole 2211 and engaged therewith. The pushing sleeve 222 further has a screw hole 2222 to which a screw rod 223 is threadedly connected. The front end of the screw rod 223 is provided with a rubber ring 224. The screw rod 223 is disposed through a restricting seat 225. The periphery of the restricting seat 225 is provided with a plurality of flanges 2251.

The polygonal seat 2221 of the pushing sleeve 222 is disposed into the polygonal hole 2211 of the rotating head 221, so that the pushing sleeve 222 can be driven by the rotating head 221 to rotate. Then, the screw rod 223 with its front end having the rubber ring 224 is disposed through the restricting seat 225 and threadedly engaged within the screw hole 2222 of the pushing sleeve 222. Then, the rotating assembly 22 is disposed into the mouth 211 of the bottle body 21, so that the flanges 2251 of the restricting seat 225 engage within the restricting recess 215 of the mouth 211, thereby completing the assembly of the inner bottle 2. Then, the feeding pipe 212 and the feeding head 213 of the inner bottle 2 are disposed through the inner plug 12 of the outer bottle 1. With the inner threaded section 214 being threadedly engaged with the threaded section 11 of the outer bottle 1, the inner bottle 2 can be combined with the outer bottle 1.

With the above structure, when the embodiment lotion bottle is used to receive the lotions such as lip gloss or eye shadow, lotions having different colors are filled in the outer bottle 1 and the inner bottle 2 respectively. When the user needs to use the lotion received in the outer bottle 1 having a desired color, the user rotates the inner bottle 2 to separate the inner bottle 2 from the outer bottle 1. At this time, the user soaks the feeding head 213 in the lotion received in the outer bottle 1 or uses the other lotion received in the inner bottle 2 only, thereby applying the desired lotion to the user's face. When the user needs to change the colors of the lotions, in addition to the lotion received in the outer bottle 1, the user may rotate the rotating seat 221 of the rotating assembly 2 so as to drive the pushing sleeve 222 to rotate accordingly. As a result, the screw rod 223 together with the rubber ring 224 provided at the front end of the screw rod 223 moves toward the interior of the mouth 211. Since the flanges 2251 of the restricting seat 225 provided on the screw rod 223 are engaged within the restricting recess 215 of the mouth 211, the rubber ring 224 moves upwards or downwards relative to the restricting seat 225 when the screw rod 223 is driven. Further, the rubber ring 224 is disposed into the feeding pipe 212 to seal the feeding pipe 212, thereby pushing the lotion in the feeding pipe 212 toward the feeding head 213. Thus, the pushed-out lotion is mixed with the lotion originally adhered onto the feeding head 213, thereby mixing different colors of lotions with each other. Further, the color shades of the lotion can be adjusted by the amount of the pushed-out lotion to thereby generate changeable mixtures of lotions of different colors.

When a skin-care lotion is received in the embodiment lotion bottle, a primary lotion having a skin-care effect may be received in the inner bottle 2, and an auxiliary lotion without a skin-care effect may be received in the outer bottle 1. Thus, when the user needs to use the skin-care essence, the user pushes the primary lotion received in the inner bottle 2 to the feeding head 213, thereby mixing the primary lotion with the auxiliary lotion received in the outer bottle 1. Since the primary lotion and the auxiliary lotion are respectively received in the inner bottle 2 and the outer bottle 1 without mixing if they are not in use, and so the chemical properties of these two lotions may not change or deteriorate. Further, the threaded engagement between the inner bottle 2 and the outer bottle 1 ensures that the lotion received in the inner bottle 2 does not come into contact with external air, thereby extending its lifetime.

According to the above, embodiments of the present invention are characterized in that: the lotion bottle comprises an inner bottle and an outer bottle, and different lotions are received in the inner bottle and the outer bottle respectively for separate use or for mixed use. Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A lotion bottle, including:

an outer bottle, the outer bottle being a hollow bottle having a mouth, the mouth having an outer edge with a threaded section; and an inner bottle having a bottle body and a rotating assembly, a lotion capable of being received in an interior of the bottle body, the rotating assembly being connected to a mouth of the inner bottle, a feeding pipe extending from the mouth toward the bottle body, a feeding head being disposed at a front end of the feeding pipe, an end of the bottle body opposite the mouth being formed with an inner threaded section;

wherein the rotating assembly has a rotating seat and a pushing sleeve, an interior of the rotating seat being provided with a polygonal hole, the pushing sleeve having a polygonal seat disposed in the polygonal hole, the pushing sleeve having a screw hole for allowing a screw rod to be threadedly engaged therein, a rubber ring provided on a front end of the screw rod, and the screw rod disposed through a restricting seat, the periphery of the restricting seat being provided with a plurality of flanges.

2. The lotion bottle according to claim 1, wherein an inner plug is disposed in a mouth of the outer bottle.

3. The lotion bottle according to claim 1, wherein the bottle body is integrally formed with the feeding pipe.

4. The lotion bottle according to claim 1, wherein the restricting seat of the rotating assembly is engaged within a restricting recess provided in the mouth of the inner bottle.

5. The lotion bottle according to claim 1, wherein a rubber ring is disposed in the feeding pipe to seal the feeding pipe.

* * * * *